US006047517A

United States Patent [19]

Vrame

[11] Patent Number: 6,047,517

[45] Date of Patent: Apr. 11, 2000

[54] HANGER FOR HANGING ELECTRICAL FIXTURE FROM SUSPENDED CEILING

[75] Inventor: Peter A. Vrame, Glenview, Ill.

[73] Assignee: 3244 Corporation, Oak Lawn, Ill.

[21] Appl. No.: 09/050,702

[22] Filed: Mar. 30, 1998

[51] Int. Cl.[7] ..... E04C 3/30

[52] U.S. Cl. ..... 52/733.3; 52/220.6; 52/506.07; 52/664; 52/669

[58] Field of Search ..... 52/733.1, 733.2, 52/733.3, 506.06, 506.07, 220.6, 220.8, 28, 39, 664, 668, 669, 696

[56] References Cited

U.S. PATENT DOCUMENTS

| | | | |
|---|---|---|---|
| 4,064,671 | 12/1977 | Sauer | 52/696 |
| 4,114,327 | 9/1978 | Williams | 52/28 |
| 4,426,822 | 1/1984 | Gailey | 52/669 |
| 4,545,165 | 10/1985 | Carey et al. | 52/488 |
| 4,757,663 | 7/1988 | Kuhr | 52/484 |
| 4,927,696 | 5/1990 | Berg | 428/195 |
| 5,428,930 | 7/1995 | Bagley et al. | 52/506.07 |

OTHER PUBLICATIONS

S–P Products, Inc., "EZ Bar Hanger System," two undated pages (admitted prior art).

*Primary Examiner*—Carl D. Friedman

*Assistant Examiner*—Yvonne M. Horton

*Attorney, Agent, or Firm*—Rockey, Milnamow & Katz, Ltd.

[57] ABSTRACT

As stamped from sheet metal, a hanger useful for hanging an electrical fixture from a suspended ceiling has a main panel, a lower flange, and an upper flange. Near each of its opposite ends, the hanger is provided with a slot defining a tab. The slot opens at and the tab extends to a projecting edge of the lower flange. Corners defined where the projecting edge of each of the upper and lower flanges meets each of the opposite ends of the hanger and where the slot opens at the projecting edge of the lower flange are rounded approximately to a radius not less than approximately 1/16 inch. Because of the rounded corners, an installer can handle the hanger and can manipulate the tabs with bare hands, without exposure to sharp corners at the corners so defined and so rounded. The slots are spaced equally from the opposite ends of the hanger. A visible indicator is stamped into but not through an expansive surface of the main panel, namely the expansive surface opposite to the expansive surface having the lower and upper flanges projecting therefrom. Because the visible indicator is centered between the opposite ends of the hanger, measuring a centerline between the opposite ends of the hanger and marking the centerline are unnecessary.

2 Claims, 2 Drawing Sheets

HANGER FOR HANGING ELECTRICAL FIXTURE FROM SUSPENDED CEILING

TECHNICAL FIELD OF THE INVENTION

This invention pertains to an improved hanger, which is stamped from sheet metal and which is useful for hanging an electrical fixture from a suspended ceiling of a known type. Sharp corners are eliminated. Measuring and marking a centerline are unnecessary.

BACKGROUND OF THE INVENTION

A suspended ceiling of the type noted above has spaced frame members, each having an upwardly projecting rail with an upper portion that is wider when compared with a lower portion of the rail. A hanger, which is stamped from sheet metal and which is useful for hanging an electrical fixture from a suspended ceiling of the type noted above, is exemplified in Williams U.S. Pat. No. 4,114,327.

As disclosed in the Williams patent, a pair of such hangers are used with suitable mounting brackets to hang an electrical fixture, such as a light fixture, a speaker box, a fire alarm box, or an exit sign from a suspended ceiling. Similar hangers are available commercially from S-P Products, Inc. of Elk Grove Village, Ill., under its trade designation "EZ Bar Hanger System".

Generally, the hanger has a main panel, an upper flange, and a lower flange and is provided near each of its opposite ends with a slot defining a tab. The slot, which opens at a projecting edge of the lower flange, extends through the lower flange, into the main body, and is adapted to accommodate the upper portion of the upwardly projecting rail of a frame member of a suspended ceiling. The tab, which extends to the projecting edge of the lower flange and to a nearer one of the opposite ends of the hanger, comprises a portion of the main panel and a portion of the lower flange and is shaped so as to lock the hanger to the upwardly projecting rail of the frame member. The slots are spaced equally from the opposite ends of the hanger.

Generally, when one of the commercially available hangers mentioned above is installed so as to coact with two frame members of a suspended ceiling, it is necessary for an installer to bend the tabs upwardly from their normal positions, so as to allow the upper portions of the frame members to enter the slots. Generally, moreover, it is necessary for the installer to bend the tabs back approximately to their normal positions so as to lock the hanger to the frame members after the slots have received the upper portions of the frame members.

Commonly, when one of the commercially available hangers mentioned above is installed, it is necessary for the installer to measure a centerline between the opposite ends of the hanger and to mark the centerline, as by means of a crayon, so that an electrical fixture being hung by means of the hanger can be readily centered between the frame members coacting with the hanger.

Measuring and marking a centerline can require from thirty seconds to one minute or more of an installer's time, which may be quite expensive for an electrical contractor having to charge one dollar (U.S. $1.00) or more for each minute of the installer's time, particularly on a large-scale job involving many repetitive installations of similar hangers.

SUMMARY OF THE INVENTION

This invention provides improvements in a hanger, as described above, whereby sharp corners are eliminated and whereby measuring and marking a centerline are unnecessary.

The hanger is similar to the hangers described above in being elongate, in having two opposite ends, in having a main panel with a lower edge, and in having a lower flange. The lower flange projects from a lower edge of the main panel and has a projecting edge.

The hanger also is similar to the hangers described above in being provided near each of its opposite ends with a slot defining a tab. The slot opens at the projecting edge of the lower flange. The tab extends to the projecting edge of the lower flange and to a nearer one of the opposite ends of the hanger.

As in the hangers defined above, corners are defined where the projecting edge of the lower flange meets each of the opposite ends of the hanger and where the slot opens at the projecting edge of the lower flange.

The hanger may have an upper flange projecting from an upper edge of the main panel and having a projecting edge with corners defined where the projecting edge of the upper flange meets the hanger ends.

According to a first aspect of this invention, each corner so defined is rounded approximately to a radius not less than approximately 1/16 inch, whereby an installer can handle the hanger and can manipulate the tabs with bare hands, without exposure to sharp corners at the corners so rounded. A radius of approximately 3/32 inch is preferred.

Alternatively, each corner so defined has a bevelled edge and is rounded approximately to a radius not less than approximately 1/16 inch where the bevelled edge meets each adjacent edge.

According to a second aspect of this invention, the hanger, as stamped from sheet metal, has a visible indicator centered between the opposite ends of the hanger, whereby measuring a centerline between the opposite ends of the hanger and marking the centerline are unnecessary.

Preferably, the visible indicator is stamped into but not through the hanger. More preferably, the visible indicator is stamped into but not through the main panel. Most preferably, the visible indicator is stamped into an expansive surface of the main panel, namely the expansive surface opposite to the expansive surface having the flange or flanges projecting therefrom.

These and other objects, features, and advantages of this invention are evident from the following description of a preferred embodiment of this invention, with reference to the accompanying drawings.

DETAILED DESCRIPTION OF THE PREFERRED EMBODIMENT

Figure 1:
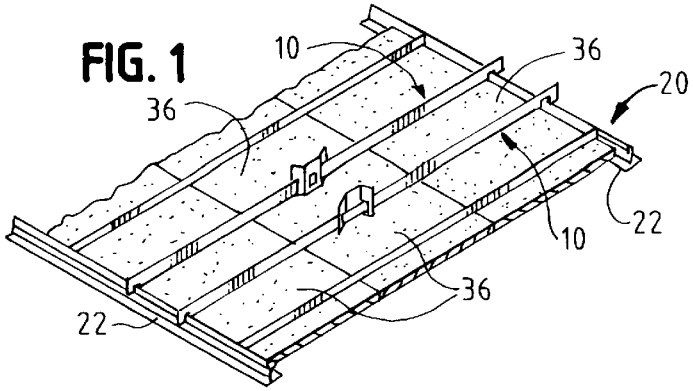
FIG. 1 is a perspective view of two similar hangers, each embodying this invention, as used with suitable mounting brackets to hang an electrical fixture, which is not shown, from a suspended ceiling comprising spaced frame members, two of which are shown.
Figure 5:
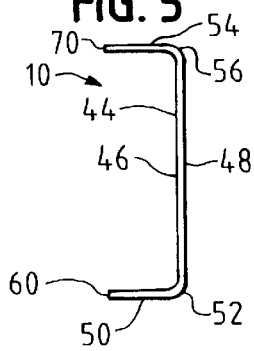
FIGS. 2, 3, 4, and 5, on a substantially larger scale, are views of one of the hangers shown in FIG. 1, as shown in front elevation, top plan, bottom plan, and end elevation respectively.

As shown in FIG. 1, two hangers 10 are used with known mounting brackets 12, which slide onto the hangers 10 in a known manner, to hang an electrical fixture (not shown) from a suspended ceiling 20. As described below, each hanger 10 constitutes a preferred embodiment of this invention, whereby sharp corners are eliminated and whereby measuring and marking a centerline are unnecessary.

Generally, the suspended ceiling 20 comprises spaced frame members 22 of a known typo, in a rectangular array. Being shaped as an inverted "T" when viewed in profile, each frame member 22 has two lower flanges 24 and an upwardly projecting rail 30, which has an upper portion 32 that is wider when compared to a lower portion 34 of the same rail 30. Moreover, the suspended ceiling 20 also comprises lightweight ceiling tiles 36 of a known type, which tiles 36 are supported by the lower flanges 24 of the frame members 22.

Generally, so as to conform to electrical codes, the hangers 10 are suspended from a true ceiling (not shown) via a pair of wires (not shown) which are secured to the hangers 10 at a pair of holes 14 (see FIG. 2) in the hangers 10. The hangers 10 also have a pair of holes 16 (see FIG. 2) which are useful for hanging electrical fixtures of certain known types, such as speaker cans, without the mounting brackets 12. Further details of the suspended ceiling 20, the mounting brackets 12, and suitable electrical fixtures to be thus hung are outside the scope of this invention and can be readily supplied by persons of ordinary skill in the art. For some of those details, one may refer made to Williams U.S. Pat. No. 4,114,327, the disclosure of which is incorporated herein by reference.

As exemplified by the hanger 10 shown in FIGS. 2, 3, 4, and 5, each hanger 10 is stamped from sheet metal, such as galvanized steel. Being elongate and having two opposite ends 40, 42, each hanger 10 is formed so as to have a main panel 44 with two expansive surfaces 46, 48, so as to have a lower flange 50 projecting from one expansive surface 46 of the main panel 44, at a lower edge 52 of the main panel 44, and so as to have an upper flange 54 projecting from the expansive surface 46 of the main panel 44, at an upper edge 56 of the main panel 44.

The lower flange 50 has a projecting edge 60, which extends between the opposite ends 40, 42, and corners 62, 64, are defined where the projecting edge 60 meets the opposite ends 40, 42. The upper flange 54 has a projecting edge 70, which extends between the opposite ends 40, 42, and corners 72, 74, are defined where the projecting edge 70 meets the opposite ends 40, 42.

Moreover, each hanger 10 is provided near the opposite ends 40, 42, with similar slots 80, 82, which are spaced equally from the opposite ends 40, 42, which extend through the lower flange 50, into the main panel 44, and which open at the projecting edge 60 of the lower flange 50. Two corners 84 are defined where the slot 80 opens at the projecting edge 60 of the lower flange 50. Two corners 86 are defined where the slot 82 opens at the projecting edge 60 of the lower flange 50.

The slot 80 defines a tab 90, which extends to the projecting edge 60 of the lower flange 50 and to the nearer end 40 of the hanger 10. The tab 90 comprises a portion of the lower flange 50 and a portion of the main body 44. The slot 82 defines a tab 92, which extends to the projecting edge 60 of the lower flange 50 and to the nearer end 42 of the hanger 10. The tab 92 comprises a portion of the lower flange 50 and a portion of the main body 44.

The slot 80 has a straight region 100 extending from the corners 84, an offset region 102 extending from the straight region 100 to the lower edge 52 of the main panel 44, and a widened, trapezoidal region 104 where the slot 80 enters the main portion 44. The slot 90 has a straight region 110 extending from the corners 86, an offset region 112 extending from the straight region 110 to the lower edge 52 of the main panel 44, and a widened, trapezoidal region 114 where the slot 80 enters the main portion 44. The widened, trapezoidal regions 104, 114, accommodate the upper portion 32 of the upwardly projecting rail 30 of the frame member 22.

Figure 7A:
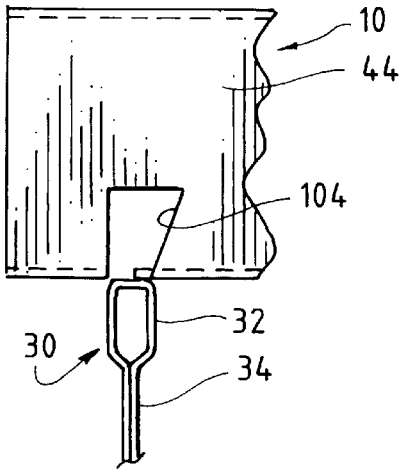
FIGS. 7A, 7B, and 7C, on the scale of FIGS. 2, 3, 4, and 5, are fragmentary views showing three successive stages in installing one of the hangers on one of the frame members. A tab is shown in a normal position preceding installation, in FIG. 7A, in an upwardly bent position during installation, in FIG. 7B, and in the normal position following installation, in FIG. 7C.
Figure 7B:
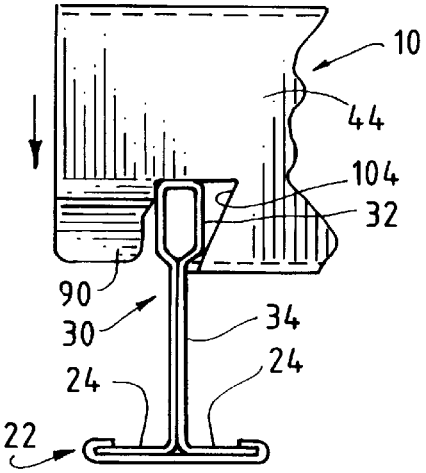
Figure 7C:
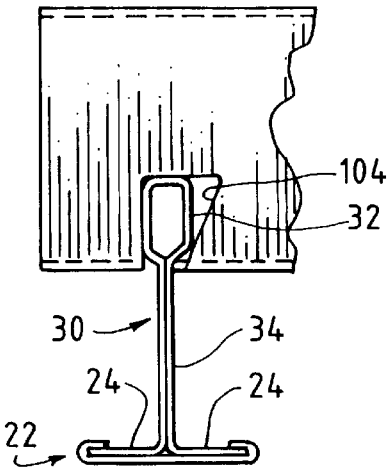
Figure 8A:
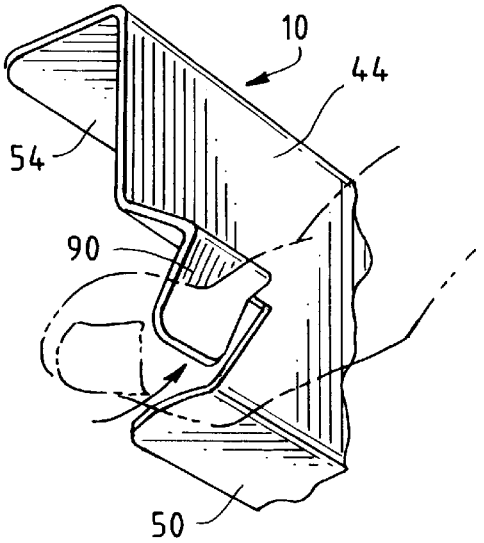
FIGS. 8A and 8B, on a slightly larger scale compared to the scale of FIGS. 7A, 7B, and 7C, are fragmentary perspective views showing the tab in the upwardly bent position during installation, in FIG. 8A, and in the normal position following installation, in FIG. 8B. A finger of an installer is shown fragmentarily, in broken lines, in FIG. 8A. A frame member is shown fragmentarily, in broken lines, in FIG. 8B.
Figure 8B:
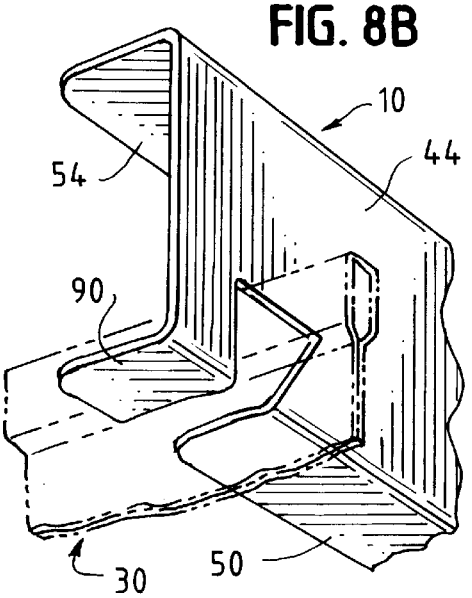

Generally, it is necessary for an installer to bend the tabs 90, 92, upwardly from their normal positions to upwardly bent positions, as shown in FIG. 7B and in FIG. 8A, so as to allow the rail portion 32 to enter the widened, trapezoidal regions 104, 114, and for the installer to bend the tabs 90, 92, back approximately to their normal positions, after the rail portion 32 has entered the widened, trapezoidal regions 104, 114, so as to lock the hanger 10 to the rail 30 of the frame member 20.

Except as illustrated and described hereinafter, the hangers 10 are similar to the hangers mentioned above as being available commercially from S-P Products, Inc. of Elk Grove Village, Ill., under its trade designation "EZ Bar Hanger System".

According to a first aspect of this invention, each of the corners 84, 86, is rounded approximately to a radius not less than approximately 1/16 inch. A radius of approximately 3/32 inch is preferred. Moreover, each of the corners 62, 64, 72, 74, is rounded similarly. Thereby, an installer can handle the hangers 10 and can manipulate the tabs 90, 92, with bare hands, as suggested in FIG. 8A, without exposure to sharp corners at the corners so rounded.

Figure 9:
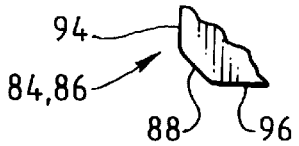
FIG. 9, on a greatly enlarged scale, is a fragmentary detail of one rounded corner, as in an alternative embodiment of this invention.

As shown in FIG. 9, in an alternative embodiment of this invention, each corner 84, 86, may have a bevelled edge 88 and may be similarly rounded to a radius not less than approximately 1/16 inch where the bevelled edge 88 meets the adjacent edges 94, 96, of the tab 90, 92, which defines such corner 84, 86.

Figure 2:
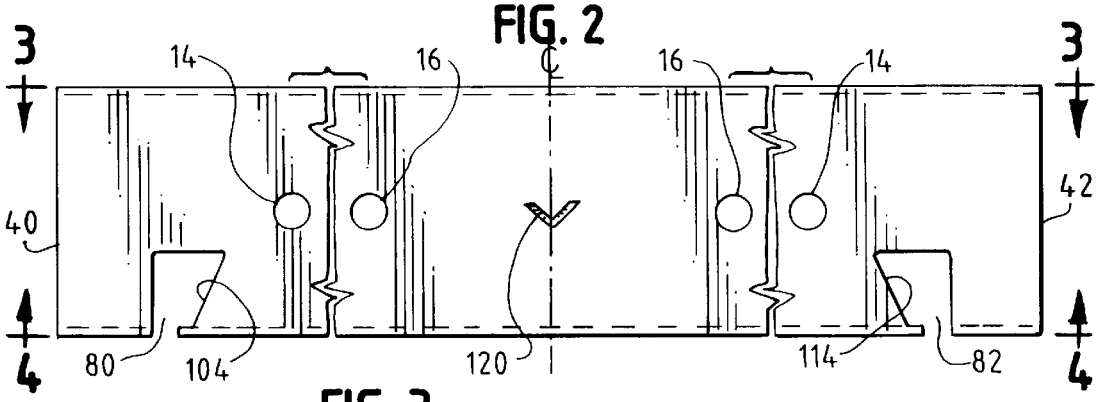
Figure 3:
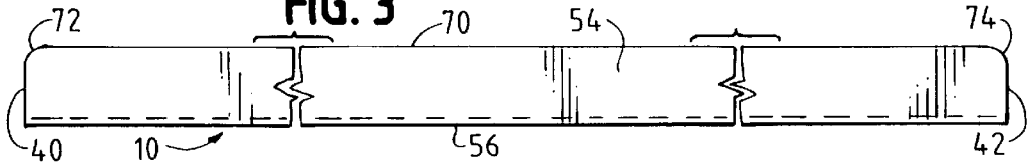
Figure 4:
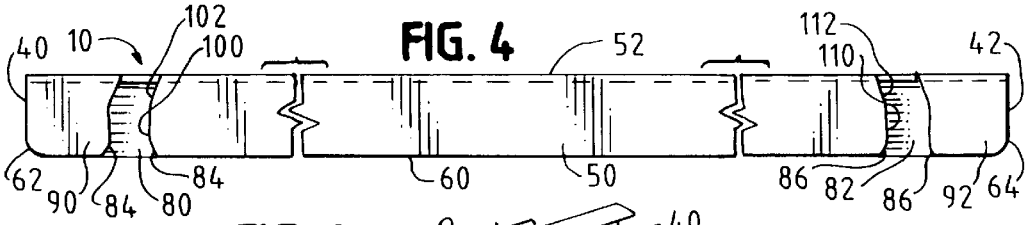
Figure 6:
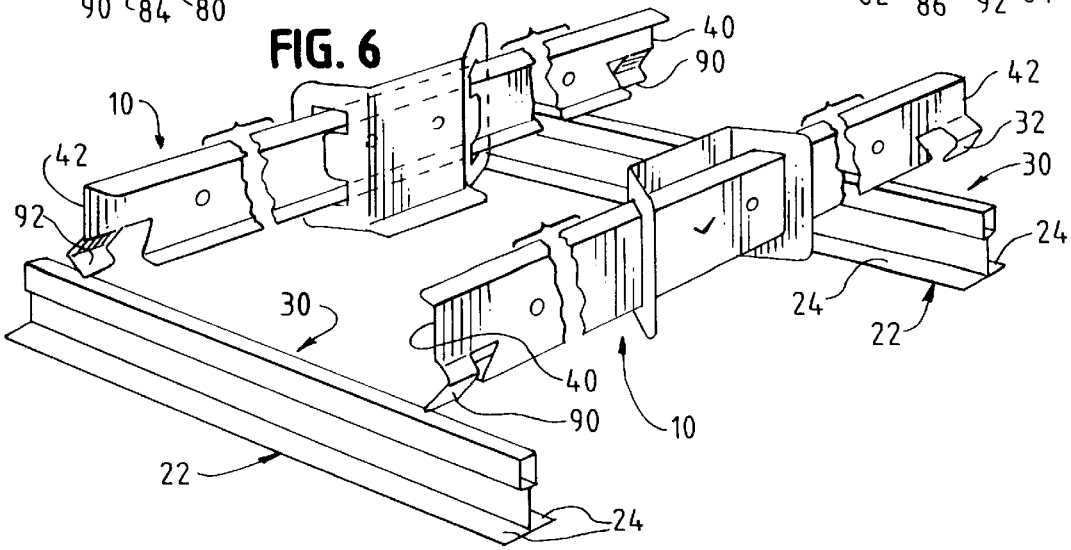
FIG. 6, on an intermediate scale, is a partly exploded, perspective view of the hangers, mounting brackets, and frame members shown in FIG. 1.

According to a second aspect of this invention, each hanger 10, as stamped from sheet metal, has a visible indicator 120 centered between its opposite ends 40, 42, whereby measuring a centerline between the opposite ends 40, 42, of the hanger and marking the centerline are unnecessary. As shown in FIG. 2, the visible indicator 120 is stamped into but not through the main panel 44, into the expansive surface 48 opposite to the expansive surface 46, from which the flanges 50, 54, project.

In an alternative embodiment (not shown) contemplated by this invention, the visible indicator 120 stamped into each hanger 10 is replaced by a raised indicator (not shown) which is formed on the main panel 44 of each hanger 10 when such hanger 10 is stamped, or by a hole or vertical slot (not shown) which is punched through the main panel 44 of each hanger 10 when such hanger 10 is stamped. The visible indicator 120, such a raised indicator, such a hole, and such a vertical slot are equivalents, each being useful as the visible indicator contemplated by this invention. This invention contemplates that each hanger 10 is provided with the visible indicator when such hanger 10 is stamped, not in a secondary operation, such as a marking operation.

Other modifications may be also made without departing from the scope and spirit of this invention.

I claim:

1. A hanger stamped from sheet metal and useful for hanging an electrical fixture from a suspended ceiling, the hanger being elongate and having two opposite ends, the hanger having a main panel with two expansive surfaces and with a lower edge and having a lower flange, the lower flange projecting from one expansive surface of the main panel, at the lower edge of the main panel, the lower flange having a projecting edge, the hanger being provided near each of the opposite ends with a slot defining a tab, the slot opening at and the tab extending to the projecting edge of the lower flange, the tab extending to whichever one of the opposite ends of the hanger has the slot defining the tab, corners being defined where the projecting edge of the lower flange meets the opposite ends of the hanger and where the slot opens at the projecting edge of the lower flange, each corner so defined being rounded approximately to a radius not less than approximately 1/16 inch, the hanger having an upper flange projecting from the expansive surface having the lower flange projecting therefrom, at an upper edge of the main panel, the upper flange having a projecting edge, corners being defined and being defined similarly where the projecting edge of the upper flange meets the opposite ends of the hanger, whereby an installer can handle the hanger and can manipulate the tab with bare hands, without exposure to sharp corners at the corners so defined and so rounded.

2. The hanger of claim 1 wherein the radius is approximately 3/32 inch.

* * * * *